US011694664B2

(12) United States Patent
Kobayashi et al.

(10) Patent No.: US 11,694,664 B2
(45) Date of Patent: Jul. 4, 2023

(54) KEYBOARD MUSICAL INSTRUMENT

(71) Applicant: CASIO COMPUTER CO., LTD., Tokyo (JP)

(72) Inventors: Ryohei Kobayashi, Akishima (JP); Kouji Oshima, Fussa (JP); Yuuki Nakajima, Tachikawa (JP); Naoto Imamura, Akishima (JP); Shingo Fukushima, Ome (JP); Mari Nakajima, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 40 days.

(21) Appl. No.: 17/468,267

(22) Filed: Sep. 7, 2021

(65) Prior Publication Data

US 2022/0076652 A1 Mar. 10, 2022

(30) Foreign Application Priority Data

Sep. 9, 2020 (JP) ..... 2020-150932

(51) Int. Cl.
*G10H 1/32* (2006.01)

(52) U.S. Cl.
CPC ..... *G10H 1/32* (2013.01); *G10H 2230/065* (2013.01); *G10H 2230/365* (2013.01)

(58) Field of Classification Search
CPC ..... G10H 1/32; G10H 2230/065; G10H 2230/365
See application file for complete search history.

(56) References Cited

U.S. PATENT DOCUMENTS 3,335,629 A * 8/1967 Brodin ..... G10H 1/32 D17/1
3,541,912 A * 11/1970 Radke ..... G10H 1/342 84/715
4,126,070 A * 11/1978 Hill ..... G10H 1/32 84/718
4,757,737 A * 7/1988 Conti ..... G10H 5/005 984/378
4,884,488 A * 12/1989 Curletto ..... G10H 1/32 984/344
D312,091 S * 11/1990 Amiya ..... D17/1
D312,264 S * 11/1990 Amiya ..... D17/1
6,842,168 B1 1/2005 Sim et al.
(Continued)

FOREIGN PATENT DOCUMENTS

JP S5117404 U 2/1976
JP H10207450 A 8/1998
(Continued)

OTHER PUBLICATIONS

Japanese Office Action dated Oct. 27, 2022 (and English translation thereof) issued in counterpart JP Application No. 2020-150932.
(Continued)

*Primary Examiner* — Robert W Horn
(74) *Attorney, Agent, or Firm* — Holtz, Holtz & Volek PC

(57) ABSTRACT

A keyboard musical instrument includes a musical instrument case including an upper case, and a lower case having a concave part provided on a lower surface and opened on an outer peripheral surface-side, and a strap pin fixing portion is arranged in the concave part.

9 Claims, 8 Drawing Sheets

(56) References Cited

U.S. PATENT DOCUMENTS

| | | | | |
|---|---|---|---|---|
| 7,361,826 | B2 | 4/2008 | Brun | |
| 7,495,163 | B1 * | 2/2009 | Goodrich | G10G 5/005 224/270 |
| 7,667,119 | B1 * | 2/2010 | Schlapkohl | G10C 3/12 84/424 |
| 7,928,312 | B2 * | 4/2011 | Sharma | G10H 1/34 84/424 |
| 10,157,602 | B2 * | 12/2018 | Hanks | G10H 1/0551 |
| 10,319,355 | B2 * | 6/2019 | Abadi | G10H 1/0091 |
| 2005/0030283 | A1 | 2/2005 | Sim et al. | |
| 2005/0045021 | A1 | 3/2005 | Berger et al. | |
| 2022/0076652 | A1 * | 3/2022 | Kobayashi | G10H 1/344 |
| 2022/0270577 | A1 * | 8/2022 | Nakajima | G10H 1/32 |

FOREIGN PATENT DOCUMENTS

| | | | |
|---|---|---|---|
| JP | 2581930 | Y2 | 9/1998 |
| JP | 2003528385 | A | 9/2003 |
| JP | 3971925 | B2 | 6/2007 |
| JP | 2009207631 | A | 9/2009 |
| JP | 3162566 | U | 8/2010 |
| JP | 2015130411 | A | 7/2015 |
| WO | 2018198379 | A1 | 11/2018 |

OTHER PUBLICATIONS

Indian Office Action dated Mar. 25, 2022, issued in counterpart Indian Application No. 202114040385.

* cited by examiner

KEYBOARD MUSICAL INSTRUMENT

CROSS REFERENCE TO RELATED APPLICATION

This application is based upon and claims the benefit of priority from prior Japanese patent application No. 2020-150932, filed on Sep. 9, 2020, the entire contents of which are incorporated herein by reference.

TECHNICAL FIELD

The present invention relates to a keyboard musical instrument.

DESCRIPTION OF RELATED ART

In the related art, disclosed is a keyboard musical instrument having strap pins for attaching a strap. The strap can be put on a shoulder to carry the keyboard musical instrument. The strap pins may be provided on side surfaces or a bottom surface of the keyboard musical instrument. For example, a keyboard musical instrument disclosed in Japanese Translation of PCT International Application Publication No. JP-T-2003-528385 has strap pins provided on side surfaces of the musical instrument.

SUMMARY

In a case where the strap pins are provided on the side surfaces of the keyboard musical instrument, when the keyboard musical instrument is placed on a table, the strap in a width direction may abut against a table surface, so that the setup of the keyboard musical instrument may rattle. In a case where the strap pins are provided on the bottom surface of the keyboard musical instrument, the strap may be sandwiched between a setup member on the bottom surface of the keyboard musical instrument in contact with the table surface and the table surface. For this reason, when setting up the keyboard musical instrument on the table, the strap should be removed for use, in some cases.

A keyboard musical instrument according to one embodiment of the present invention includes a musical instrument case including an upper case and a lower case having a concave part opened on an outer peripheral surface-side, and a strap pin fixing portion is arranged in the concave part.

According to the present invention, it is possible to be stably set up on a table or the like even when a strap is attached thereto.

BRIEF DESCRIPTION OF DRAWINGS

FIG. 6A to FIG. 6C are bottom views showing a state where a strap is attached to the keyboard musical instrument according to the embodiment of the present invention, in which FIG. 6A shows a case where the strap is located on a front side, FIG. 6B shows a case where the strap is located on a side, and FIG. 6C shows a case where the strap is located on a rear side.

DESCRIPTION OF EMBODIMENTS

Figure 1:
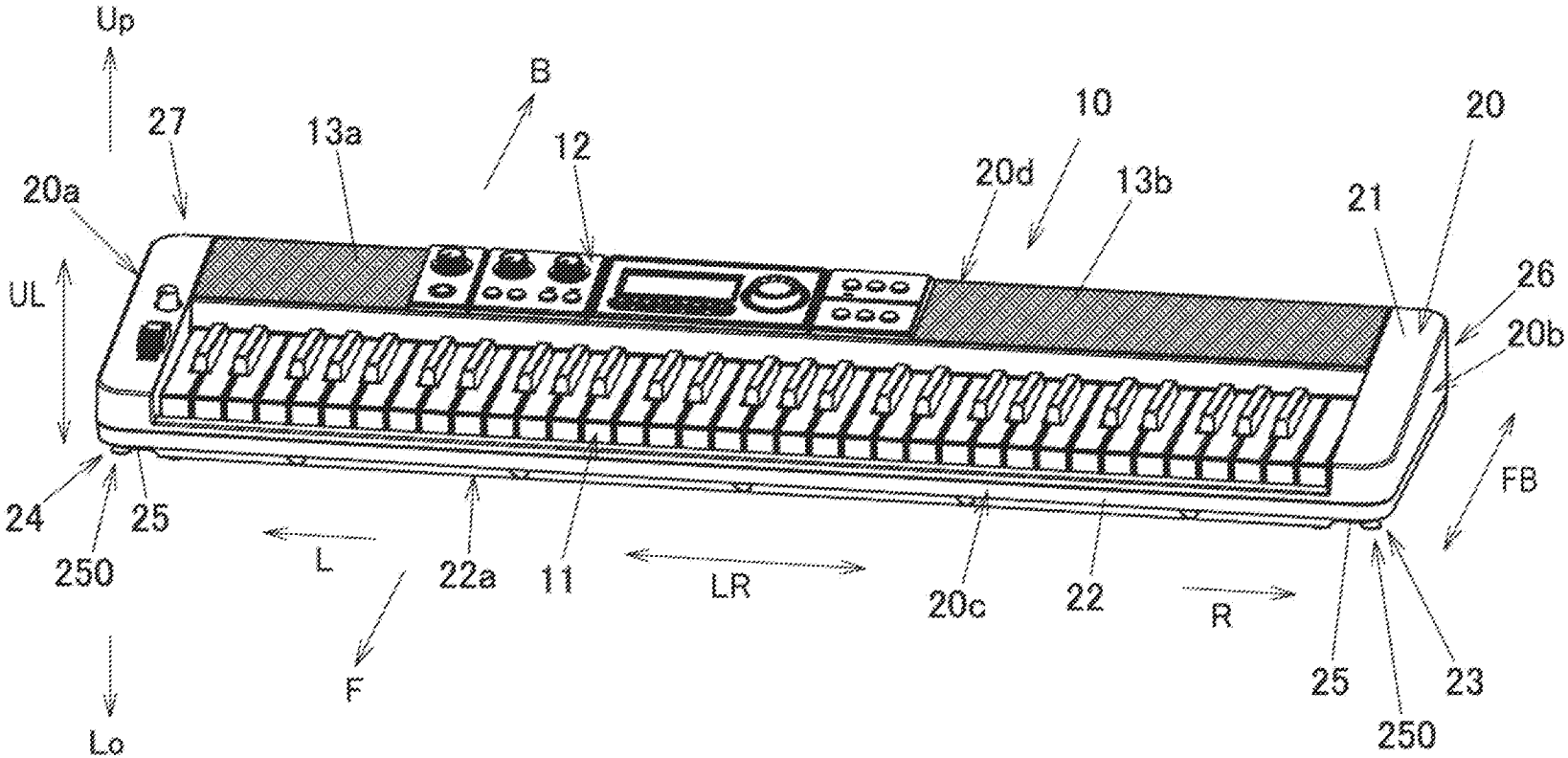
FIG. 1 is a perspective view of a keyboard musical instrument according to an embodiment of the present invention, as seen from the front.

Hereinafter, embodiments of the present invention will be described with reference to the drawings. A keyboard musical instrument 10 shown in FIG. 1 includes a keyboard 11 having 61 keys, and a musical instrument case 20. Note that, in descriptions below, the front in a front and rear direction FB of the keys of the keyboard 11 is denoted as the front side F, the rear in the front and rear direction FB of the keys is denoted as the rear side B, and when facing the keyboard 11, the left is denoted as the left side L and the right is denoted as the right side R. An alignment direction LR of the keys of the keyboard 11 is a right and left direction. In addition, the upper in an upper and lower direction UL of the keyboard musical instrument 10 is denoted as the upper side Up, and the lower is denoted as the lower side Lo.

The musical instrument case 20 has a substantially long rectangular plate shape where the right and left direction is a longitudinal direction, and is divided into an upper case 21 and a lower case 22. The upper case 21 and the lower case 22 are each formed of a resin material. In the musical instrument case 20, a substrate, a battery that is a power supply, and the like are accommodated.

The keyboard musical instrument 10 has an operation unit 12 for performing diverse settings and the like on a rear upper surface of the musical instrument case 20. Speaker units 13*a* and 13*b* are each provided on the left side L and the right side R of the operation unit 12. Although not shown, the speaker units 13*a* and 13*b* are each constituted in such a way that a plurality of holes is penetrated in the upper surface of the musical instrument case 20 and speakers are provided in an inside of the musical instrument case 20 corresponding to the holes. Note that, the speaker units 13*a* and 13*b* are each attached with a fabric.

Figure 2:
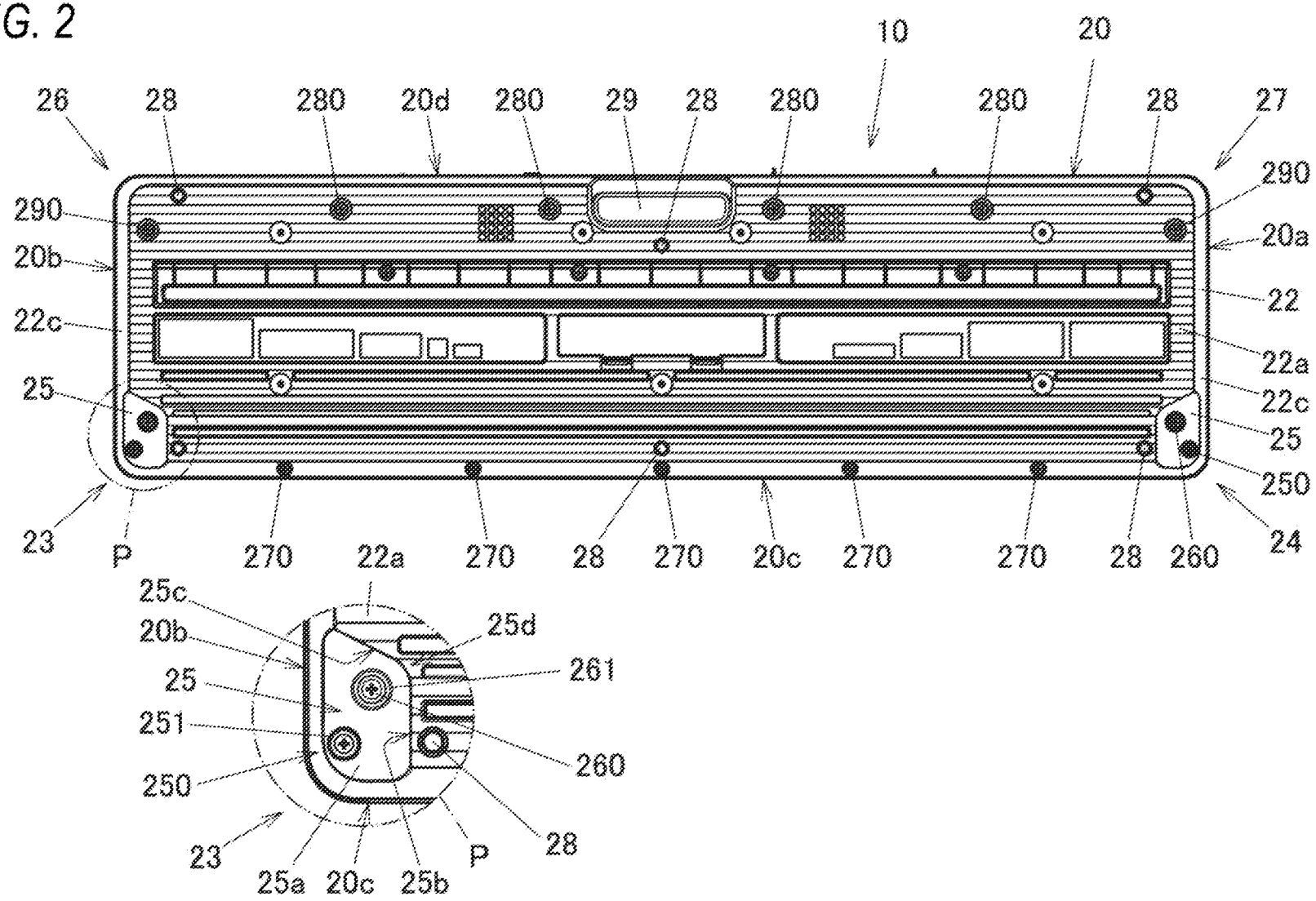
FIG. 2 is a bottom view of the keyboard musical instrument according to the embodiment of the present invention.

The lower case 22 is provided with concave parts 25 recessed from a lower surface 22*a* of the lower case 22 at a corner part 23 on a right front side and a corner part 24 on a left front side of the musical instrument case 20. As shown in FIG. 2, each of the concave parts 25 has a shape where an outer peripheral surface-side of the musical instrument case 20 close to each concave part 25 is opened. Specifically, as shown in the P part in FIG. 2, the concave part 25 at the corner part 23 on the right front side is opened on a right surface 20*b*-side and a front surface 20*c*-side, which are an outer peripheral surface of the musical instrument case 20 close to the concave part 25. The concave part 25 at the corner part 23 on the right front side is provided with wall portions 25*b* and 25*c* erected from a bottom surface 25*a* of the concave part 25. The wall portion 25*b* is provided on a left surface 20*a*-side of the concave part 25 at the corner part 23. The wall portion 25*c* is provided on a rear surface 20*d*-side.

Note that, the concave part 25 at the corner part 24 on the left front side is formed symmetrically with respect to the concave part 25 at the corner part 23 on the right front side. Therefore, in descriptions below, the concave part 25 at the corner part 23 on the right front side is described in detail, and the detailed descriptions of the concave part 25 at the corner part 24 on the left front side are omitted.

The wall portion 25*b* that is long in the front and rear direction FB is provided substantially perpendicular to the front surface 20*c* of the musical instrument case 20 (in other words, in parallel to the left surface 20*a* and the right surface 20*b*), as seen from above. The wall portion 25*c* that is long in the right and left direction (the alignment direction LR of the keys) is provided inclined toward the rear surface 20*d* with respect to a direction perpendicular to the wall portion 25*b* (in other words, with respect to the front surface 20*c* and the rear surface 20*d*). Specifically, a length of the bottom surface 25*a* of the concave part 25 in the front and rear direction FB is longer on an outer side (the right surface 20*b*-side) than an inner side (the wall portion 25*b*-side). In the present embodiment, an inclination angle of the wall portion 25*c* with respect to the front surface 20*c* is about 64°. An intersection portion 25*d* of the wall portions 25*b* and 25*c* has a rounded shape, as seen from above. In other words, the concave part 25 is opened on the front surface 20*c*-side (the front side) in the front and rear direction FB of the keys and on the right surface 20*b*-side (the outer side) in the alignment direction LR of the keys. The concave part 25 has the wall portion 25*c* on the rear side in the front and rear direction FB of the keys and the wall portion 25*b* on the inner side in the alignment direction LR of the keys.

A setup portion 28 is provided near the wall portion 25*b*, i.e., near the concave part 25 on the lower surface 22*a* of the lower case 22. The setup portion 28 is a portion that comes into contact with a table surface, which is a setup surface, when setting up the keyboard musical instrument 10 on a table, and is formed of an elastic material such as rubber. Note that, the setup portion 28 is also provided at central portions of the front and rear sides and near the corner part 26 on the rear side B of the right side R and the corner part 27 on the rear side B of the left side L as well as near the concave part 25. In addition, the lower surface 22*a* of the lower case 22 is provided with a grip part 29 having a concave shape at a substantially central part in the right and left direction, which is near the rear surface 20*d*.

The bottom surface 25*a* of the concave part 25 is provided with a strap pin fixing portion 250 for fixing a strap pin 251, and a connecting bolt 260. The connecting bolt 260 arranged in the concave part 25 is one of a plurality of connecting members for connecting the upper case 21 and the lower case 22 each other. Specifically, in addition to the connecting bolt 260 provided in the concave part 25, the front side F of the musical instrument case 20 is provided with five connecting bolts 270 along the front surface 20*c*-side, and the rear side B is provided with four connecting bolts 280 along the rear surface 20*d*. The left side L and the right side R are each provided with two connecting bolts 260 and 290 along the left surface 20*a* and the right surface 20*b*. The connecting bolts 290 are arranged near the corner parts 26 and 27 on the rear side B. An alignment direction of the two connecting bolts 260 and 290 arranged on each of the front side F and the rear side B on each of the left side L and the right side R are orthogonal to an alignment direction of the plurality of connecting bolts 270 and 280 each arranged side by side in the right and left direction on each of the front side F and the rear side B.

The connecting bolt 260 provided in the concave part 25 is provided near the intersection portion 25*d* at which the wall portions 25*b* and 25*c* of the concave part 25 intersect with each other. As shown in the P part in FIG. 2 and FIG. 5, the connecting bolt 260 is provided in a counterbore portion 261 for a connecting bolt deeply bossed from the bottom surface 25*a* of the concave part 25 toward an inside of the musical instrument case 20. The connecting bolt 260 is screwed into a female screw portion 262 provided in an inner surface of the upper case 21 and having a boss shape corresponding to the counterbore portion 261 for a connecting bolt. An upper surface of the boss shape of the counterbore portion 261 for a connecting bolt is provided with a ring-shaped guide portion 261*a* having a bowl shape so as to guide the female screw portion 262 upon fitting with the boss-shaped female screw portion 262.

Figure 3:
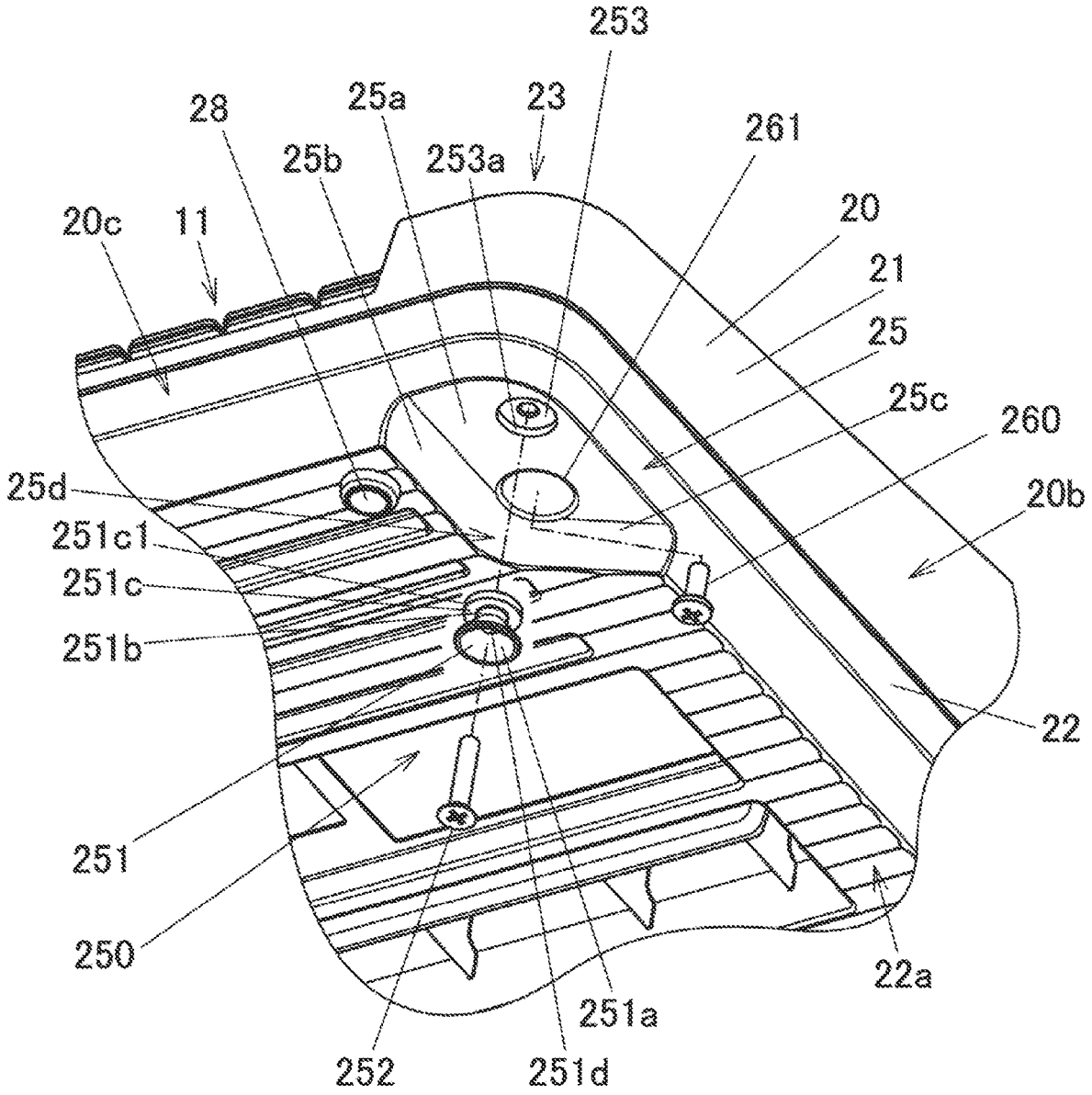
FIG. 3 is an exploded perspective view around a concave part of the keyboard musical instrument according to the embodiment of the present invention.

As shown in the P part in FIG. 2 and FIG. 3, the strap pin fixing portion 250 is arranged on an outermore side than the connecting bolt 260 with respect to the musical instrument case 20. Specifically, the strap pin fixing portion 250 is provided near an edge portion of the bottom surface 25*a* of the concave part 25 and near a part at which the right surface 20*b* and the front surface 20*c* intersect with each other (i.e., near an edge portion of the corner part 23).

As shown in FIG. 3, a strap pin 251 is fixed to the strap pin fixing portion 250 by means of a bolt 252 for attachment. The strap pin 251 has a conical portion 251*a* whose conical top portion is faced toward the musical instrument case 20, a substantially cylindrical connection portion 251*b* connecting to the top portion-side of the conical portion 251*a*, and a circular plate-shaped seat portion 251*c* connecting to the connection portion 251*b* and having a predetermined thickness. The strap pin 251 is provided with a through-hole 251*d* axially penetrating the strap pin 251.

Figure 5:
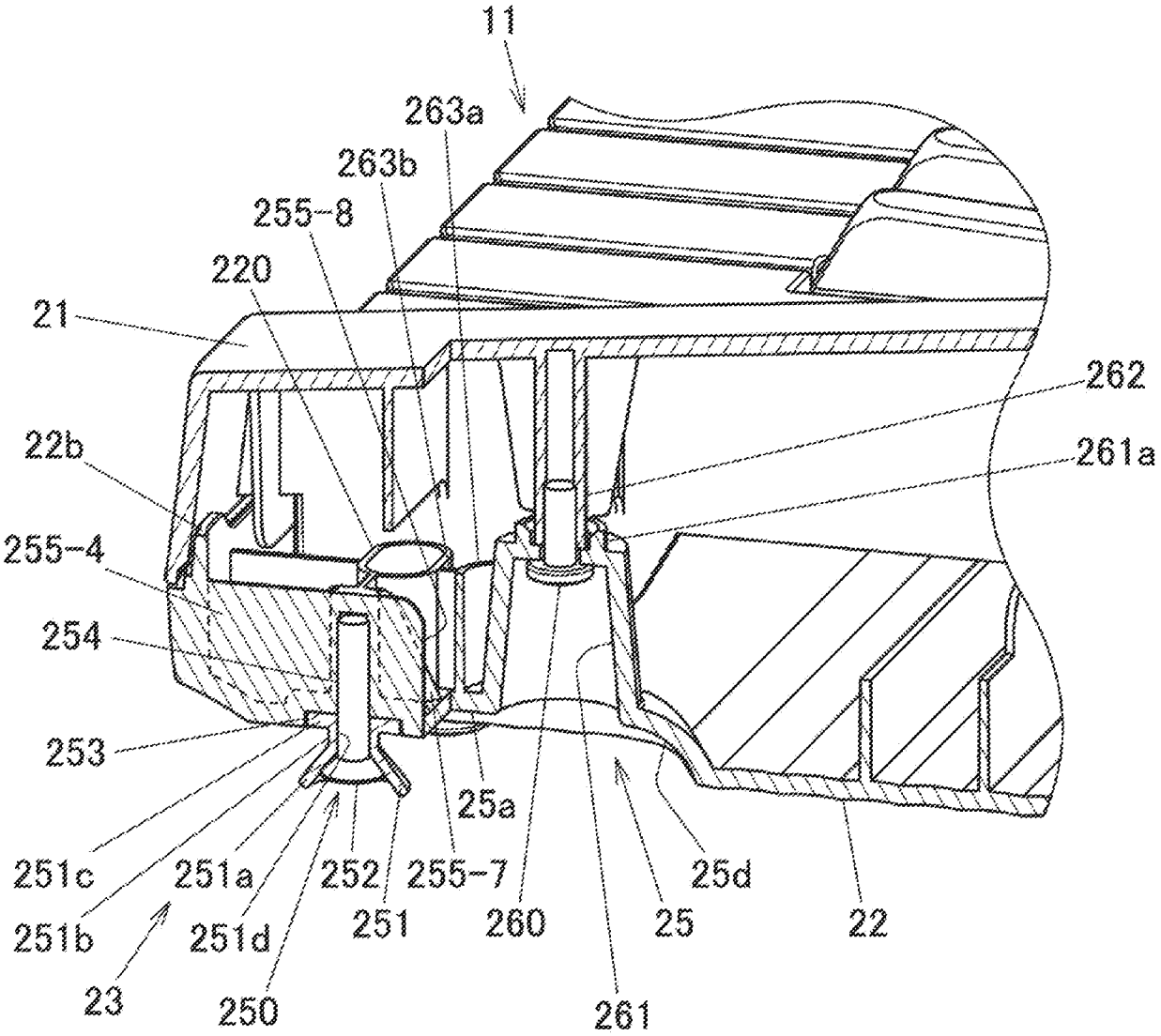
FIG. 5 is a sectional view of the keyboard musical instrument according to the embodiment of the present invention, taken along a line V-V of FIG. 4.

The bottom surface 25*a* of the concave part 25 is provided with a circular counterbore portion 253 for a strap pin, as seen from above, in which the seat portion 251*c* of the strap pin 251 is arranged. As shown in FIG. 5, an inside of the lower case 22 corresponding to the counterbore portion 253 for a strap pin is provided with a female screw portion 254 coaxially with the counterbore portion 253 for a strap pin. As described later, the female screw portion 254 is provided in a boss shape inside the lower case 22. The bolt 252 for attachment of the pin member 251 is inserted into the through-hole 251*d* of the pin member 251 and is screwed with the female screw portion 254.

Figure 4:
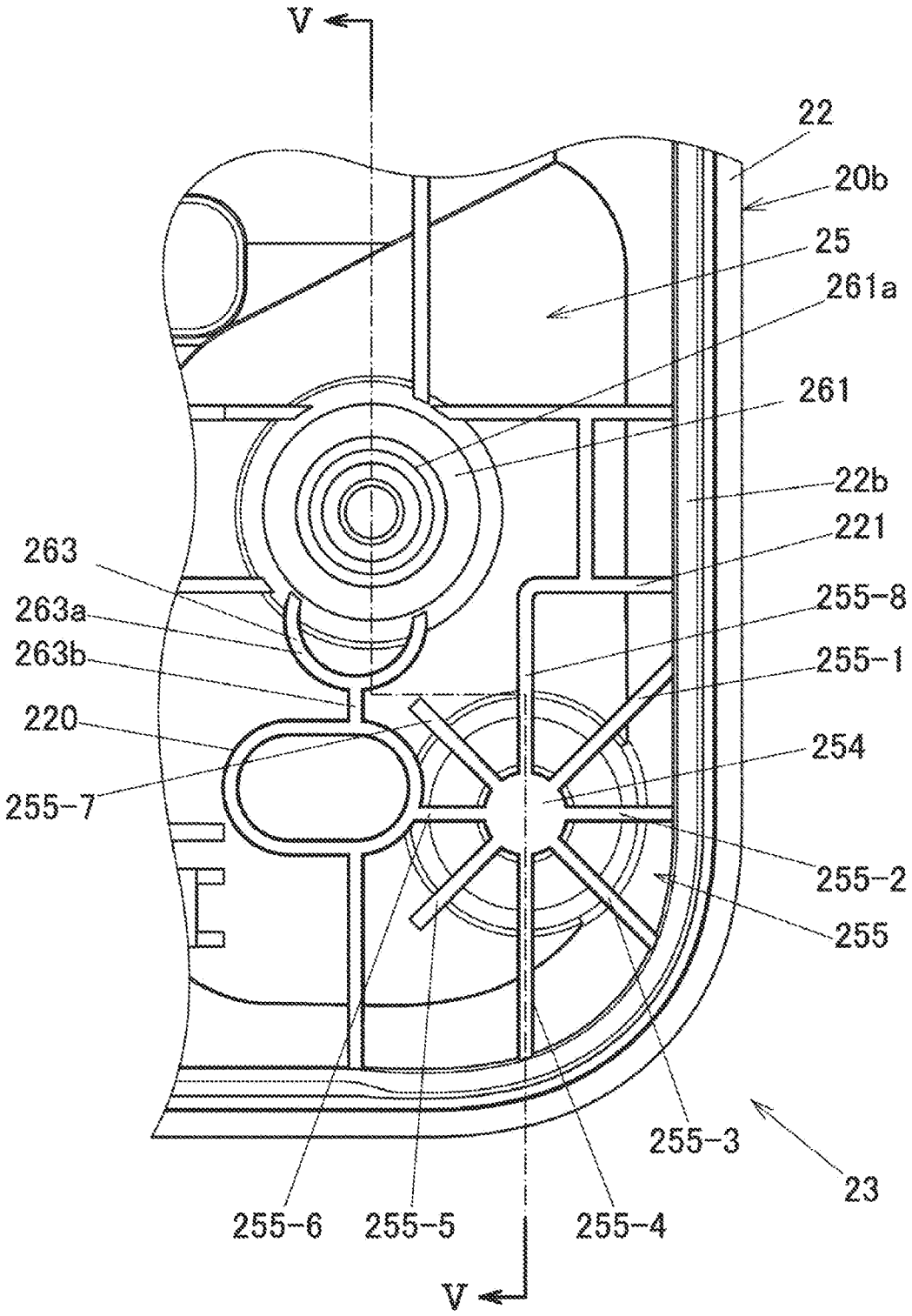
FIG. 4 is a plan view of a lower case of the keyboard musical instrument according to the embodiment of the present invention, as seen from above.

As shown in FIG. 4 and partially in FIG. 5, in the lower case 22, the boss-shaped female screw portion 254 has a plurality of first ribs 255. In the present embodiment, the eight first ribs 255-1 to 255-8 are radially provided around the female screw portion 254. Among the plurality of first ribs 255, the first ribs 255-1 to 255-4 are connected to an outer periphery wall portion 22*b* erected on an outer peripheral edge of the lower case 22. Specifically, the first ribs 255-1 to 255-4 close to the outer periphery wall portion 22*b* are directly connected to the outer periphery wall portion 22*b*.

Among the first ribs 255-5 to 255-8 distant from the outer periphery wall portion 22*b*, the first ribs 255-5 and 255-7 are not connected to any erection portion (a rib and the like) inside the lower case 22. Among the first ribs 255-5 to 255-8 distant from the outer periphery wall portion 22*b*, the first rib 255-6 extending in a direction of the left side L toward an inner side of the lower case 22 is connected to a tubular part 220, which will be described later. Among the first ribs 255-5 to 255-8 distant from the outer periphery wall portion 22*b*, the first rib 255-8 extending in a direction of the rear side B toward an inner side of the lower case 22 is connected to a rib 221 extending from the right surface 20*b*-side in the direction of the left side L toward an inner side of the lower case 22 and bent in a direction of the front side F. All of the first ribs 255-5 to 255-8 distant from the outer periphery wall portion 22*b* are not directly connected to the counterbore portion 261 for a connecting bolt.

The counterbore portion 261 for a connecting bolt has a second rib 263. The second rib 263 is arranged on a side of the front side F of the counterbore portion 261 for a connecting bolt. The second rib 263 has an arc-shaped rib 263*a* having both ends connected to the counterbore portion 261 for a connecting bolt, and a linear rib 263*b* connected to the arc-shaped rib 263*a*. The linear rib 263*b* is connected to the tubular part 220.

Figure 8:
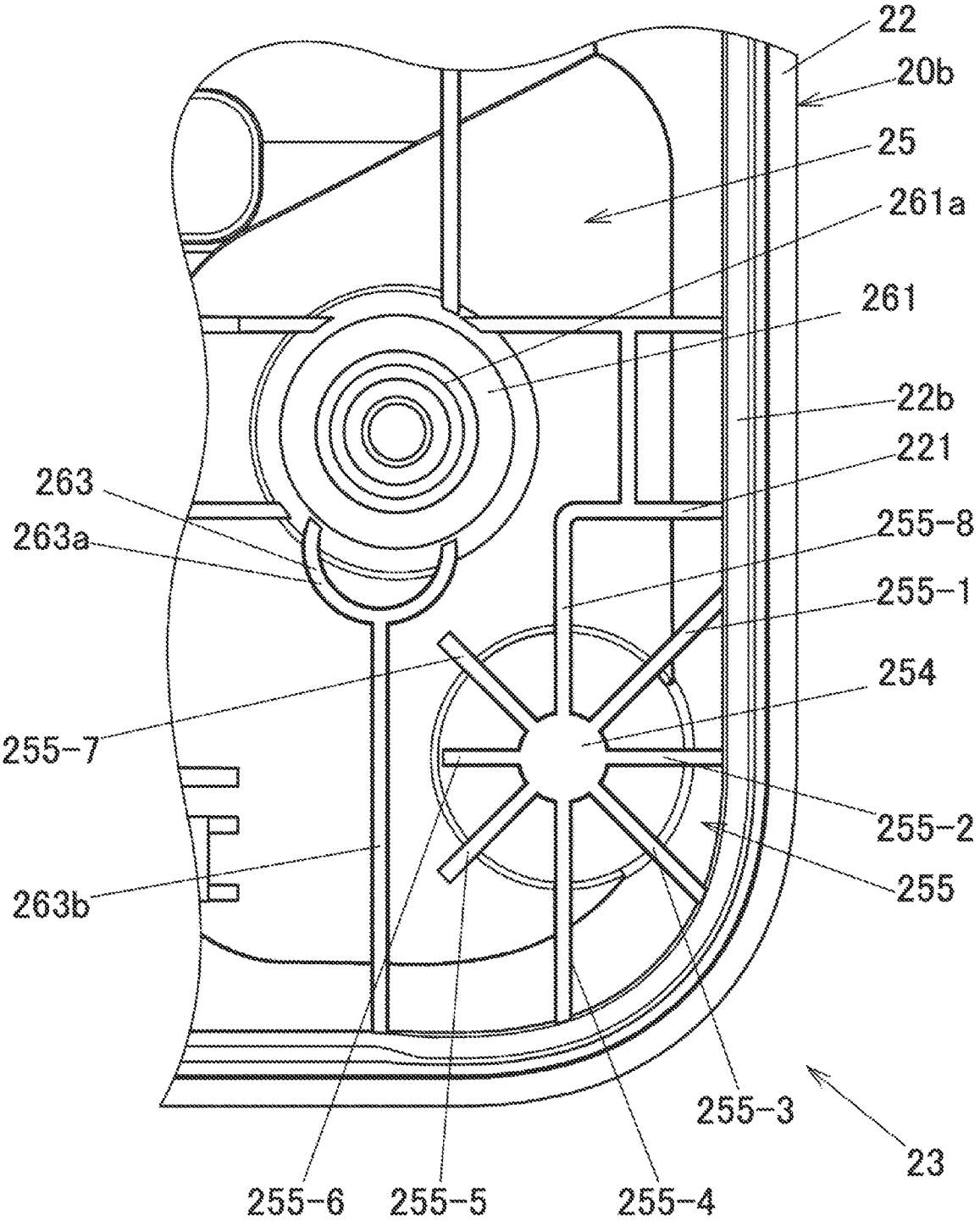
FIG. 8 is a plan view showing a modified embodiment of the keyboard musical instrument according to the embodiment of the present invention, depicting a lower case, as seen from above.

Note that, as shown in FIG. 8, the tubular part 220 may be omitted. In this case, the first rib 255-6 connected to the tubular part 220 is not connected to any erection portion (a rib and the like) inside the lower case 22.

As shown in FIGS. 6A to 6C and FIG. 7, a strap 100 can be attached to the strap pin 251 of the strap pin fixing portion 250 of the keyboard musical instrument 10. Here, as for the strap 100, the well-known strap 100 can be used. The well-known strap 100 is formed at an end portion with a slit, so that the strap pin 251 can be inserted. The slit of the strap 100 attached to the strap pin 251 is rotatably engaged with the connection portion 251*b* of the strap pin 251.

Figure 6A:
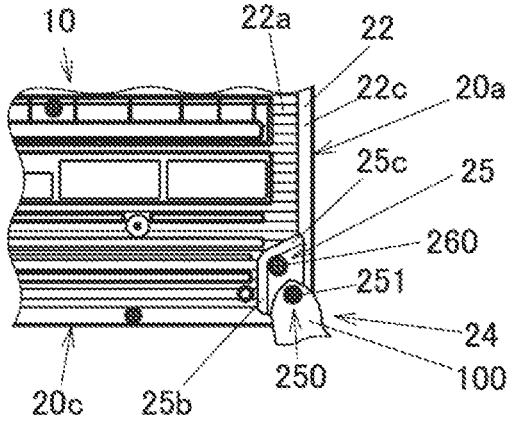
Figure 6B:
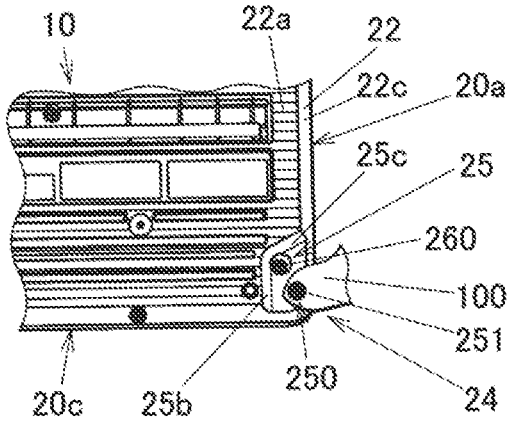
Figure 6C:
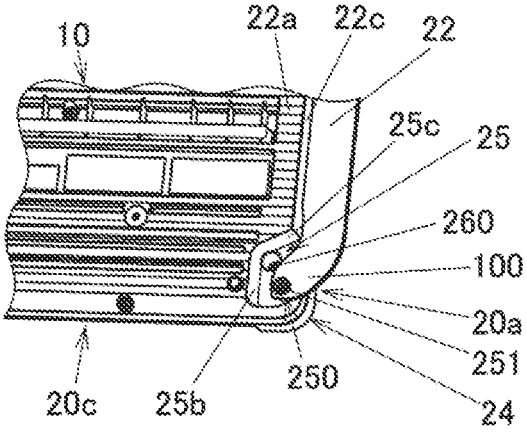

Referring to FIGS. 6A to 6C, for example, when carrying the keyboard musical instrument 10 with putting the strap 100 on a shoulder, the strap 100 extends forward, as shown in FIG. 6A. When the keyboard musical instrument 10 is placed on a table, the strap 100 can be tilted to either the left or the right (to the left side L, in FIG. 6B) so that the strap 100 extends either leftward or rightward, as shown in FIG. 6B, or can be turned rearward, as shown in FIG. 6C.

As shown in FIG. 6C, when the strap 100 is turned rearward, the strap 100 can be turned rearward without interfering with the musical instrument case 20 because the wall portion 25*c* of the concave part 25 is provided inclined. Further, since lower edge portions of the lower case 22 at the left side L and the right side R are provided with chamfered portions 22*c* (also refer to FIG. 7), each of which has a concave arc shape as seen from the front, the interference between the strap 100 and the musical instrument case 20 (lower case 22) is avoided.

Figure 7:
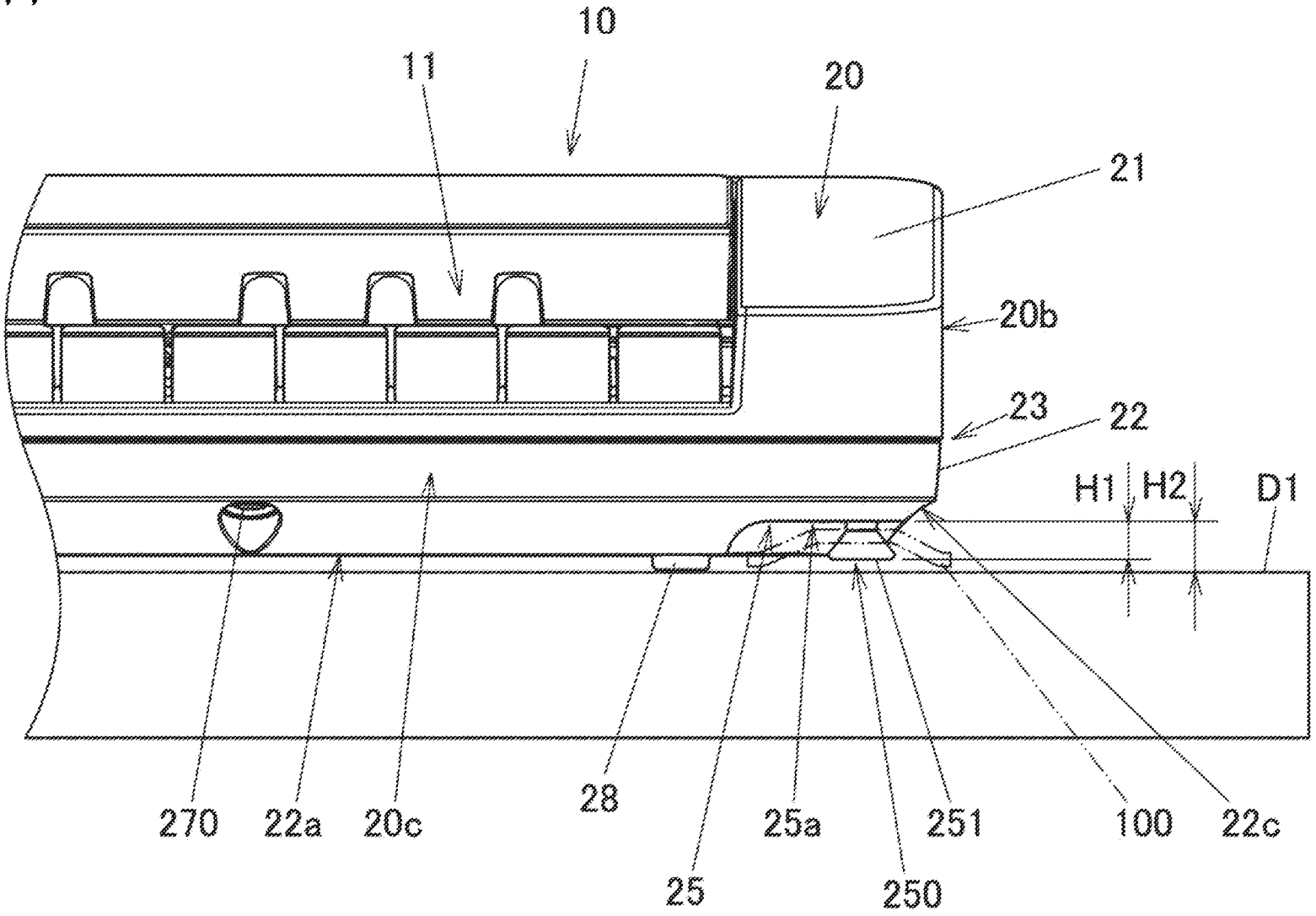
FIG. 7 is a front view showing a state where the keyboard musical instrument with the strap being attached according to the embodiment of the present invention is placed on a table.

Further, as shown in FIG. 7, the strap pin 251 of the strap pin fixing portion 250 is provided such that a height H1 from the bottom surface 25*a* of the concave part 25 to a tip end of the strap pin 251 is less than a height from the bottom surface 25*a* to a table surface D1, i.e., a height H2 from the bottom surface 25*a* to the lowest surface of the musical instrument case 20, against which the setup portion 28 abuts. Therefore, even when the keyboard musical instrument 10 is set up on the table, the keyboard musical instrument 10 can be used without rattling of the keyboard musical instrument 10, which is caused when the strap 100 is sandwiched between the lower surface of the keyboard musical instrument 10 (the lower surface 22*a* of the lower case 22) and the table surface D1 or without removing the strap 100 so as to prevent the rattling. Note that, the strap pin 251 further protrudes than the lower surface 22*a* of the lower case 22 so as to easily attach the strap 100.

In addition, when carrying the keyboard musical instrument 10 with putting the strap 100 on a shoulder, a load of the keyboard musical instrument 10 is applied to the strap pin 251. That is, a shear load is applied to the female screw portion 254 screwed with the bolt 252 of the strap pin fixing portion 250 shown in FIG. 5. As for the shear load, the first ribs 255-1 to 255-4 connected to the outer periphery wall portion 22*b* of the lower case 22 shown in FIG. 4 support the boss-shaped female screw portion 254. Further, in this case, the outer periphery wall portion 253*a* of the counterbore portion 253 for a strap pin shown in FIG. 3 abuts against a side surface 251*c*1 of the seat portion 251*c* of the strap pin 251, so that the shear load applied to the bolt 252 and the female screw portion 254 is relieved.

In addition, when the keyboard musical instrument 10 is dropped and an impact force is thus applied to the strap pin 251, the first ribs 255-5 to 255-8 shown in FIG. 4 support the female screw portion 254. At this time, since the first ribs 255-5 to 255-8 are not connected to another erection portion in the lower case 22, particularly, the counterbore portion 261 for a connecting bolt provided in the same concave part 25, propagation of the impact force applied to the strap pin 251 to the counterbore portion 261 for a connecting bolt is reduced.

Further, when the keyboard musical instrument 10 is dropped and an impact force is thus applied to the strap pin 251, even though the impact force is transferred along a structure in the lower case 22 and accordingly propagates to the counterbore portion 261 for a connecting bolt, stress concentration on a connection portion between the second rib 263 (arc-shaped rib 263*a*) and the counterbore portion 261 for a connecting bolt is relieved because the second rib 263 is connected to the counterbore portion 261 for a connecting bolt in a biforked shape.

According to the embodiment of the present invention, the keyboard musical instrument 10 includes the musical instrument case 20 including the upper case 21 and the lower case 22 having the concave part 25 opened on the outer peripheral surface-side that is the left surface 20*a* (or the right surface 20*b*) and the front surface 20*c*, and the strap pin fixing portion 250 is arranged in the concave part 25.

Thereby, even when the strap pin 251 is attached to the strap pin fixing portion 250 and the keyboard musical instrument 10 is placed on the table or the like with the strap 100 being attached to the strap pin 251, the strap 100 is not sandwiched between the keyboard musical instrument 10 and the table, so that the keyboard musical instrument 10 can be stably placed.

In addition, the setup portion 28 is provided near the concave part 25 on the lower surface 22*a* of the lower case 22. Thereby, it is possible to securely form a distance between the tip end of the strap pin 251 attached to the strap fixing portion 250 and a ground contact surface.

Further, the keyboard musical instrument 10 includes the connecting bolts 260, 270, 280 and 290, which are connecting members for fixing the upper case 21 and the lower case 22, and the connecting bolt 260 is arranged in the concave part 25. Thereby, it is possible to equally arrange the connecting bolts 260, 270, 280 and 290 on the front and rear sides and on the right and left sides.

Further, the length of the concave part 25 in the front and rear direction FB is longer on the outer side than on the inner side. Thereby, the wall portion 25*c* of the concave part 25 can be inclined in the right and left direction with respect to the wall portion 25*b*, so that a rotating range of the strap 100 can be increased.

Further, the strap pin fixing portion 250 includes the counterbore portion 253 for a strap pin. Thereby, the outer periphery wall portion 253*a* of the counterbore portion 253 for a strap pin and the side surface 251*c*1 of the seat portion 251*c* of the strap pin 251 attached to the strap pin fixing portion 250 can be caused to abut against each other. Accordingly, the static load applied to the strap pin fixing portion 250 (the load that is applied when the keyboard musical instrument 10 is put on the shoulder by means of the strap 100) can be more securely supported.

Further, the female screw portion 254 for screw-fixing the strap pin 251 is provided in a boss shape inside the lower case 22, the female screw portion 254 has the plurality of first ribs 255-1 to 255-8, the counterbore portion 261 for a connecting bolt is provided in a boss shape inside the lower case 22, and all of the first ribs 255-1 to 255-8 are not directly connected to the counterbore portion 261 for a connecting bolt. Thereby, even when the keyboard musical instrument 10 is dropped and thus the strap pin 251 collides with a floor surface, an influence of the impact on the counterbore portion 261 for a connecting bolt is reduced.

Further, the counterbore portion 261 for a connecting bolt has the second rib 263 inside the lower case 22, and the second rib 263 has the arc-shaped rib 263*a* whose both end portions are connected to the counterbore portion 261 for a connecting bolt, and the linear rib 263*b*. Thereby, stress concentration on a part at which the second rib is directly connected to the counterbore portion 261 for a connecting bolt can be relieved.

Further, the concave part 25 is provided on each of the two corner parts 23 and 24 on the keyboard 11-side (i.e., the front side F) of the musical instrument case 20. Thereby, when the strap 100 is put on the shoulder, the keyboard musical instrument 10 can be carried in a state where the keyboard 11-side, which is likely to be damaged when the keyboard musical instrument 10 is dropped, is faced toward the upper side.

Although some embodiments of the present invention have been described, the embodiments are just exemplary and are not intended to limit the scope of the invention. The novel embodiments can be implemented in other diverse forms, and can be diversely omitted, replaced and changed without departing from the gist of the invention. The embodiments and modifications thereof are included within the scope and gist of the invention, and are particularly included in the invention defined in the claims and the equivalents thereof.

What is claimed is:

1. A keyboard musical instrument comprising:

a musical instrument case including an upper case and a lower case having a concave part opened on an outer peripheral surface-side of the musical instrument case, wherein a strap pin fixing portion is provided in the concave part.

2. The keyboard musical instrument according to claim 1, wherein a setup portion where the keyboard musical instrument comes into contact with a setup surface is provided adjacent to the concave part of the lower case.

3. The keyboard musical instrument according to claim 1, further comprising a connecting member configured to fix the upper case and the lower case to each other, wherein the connecting member is provided in the concave part.

4. The keyboard musical instrument according to claim 1, wherein a length of the concave part in a front and rear direction of keys of the keyboard musical instrument is longer on an outer side of the concave part than on an inner side thereof.

5. The keyboard musical instrument according to claim 1, wherein the strap pin fixing portion includes a counterbore portion configured to receive a strap pin.

6. The keyboard musical instrument according to claim 1, wherein a female screw portion configured to receive a screw for fixing a strap pin is provided in a boss shape inside the lower case, wherein the female screw portion has a plurality of first ribs, wherein a counterbore portion configured to receive a connecting member, which is configured to fix the upper case and the lower case to each other, is provided in a boss shape inside the lower case, and wherein none of the plurality of first ribs is directly connected to the counterbore portion.

7. The keyboard musical instrument according to claim 6, wherein the counterbore portion has a second rib inside the lower case, and wherein the second rib includes an arc-shaped rib whose both end portions are connected to the counterbore portion, and a linear rib extending from the arc-shaped rib.

8. The keyboard musical instrument according to claim 1, wherein the concave part is provided at each of two corner parts on a keyboard-side of the musical instrument case, the musical instrument case having a long rectangular plate shape.

9. The keyboard musical instrument according to claim 1, wherein the concave part is opened on a front side in a front and rear direction of keys of the keyboard musical instrument and on an outer side in an alignment direction of the keys, and has a wall portion on a rear side in the front and rear direction of the keys and on an inner side in the alignment direction of the keys.

* * * * *